US007581552B2

(12) United States Patent
Jeon et al.

(10) Patent No.: US 7,581,552 B2
(45) Date of Patent: Sep. 1, 2009

(54) DRIVE UNIT FOR DISH WASHING MACHINES

(75) Inventors: Si Moon Jeon, Seoul (KR); Tae Hee Lee, Bucheon-si (KR); Young Hwan Park, Seoul (KR)

(73) Assignee: LG Electronics Inc., Seoul (KR)

( * ) Notice: Subject to any disclaimer, the term of this patent is extended or adjusted under 35 U.S.C. 154(b) by 701 days.

(21) Appl. No.: 11/188,759

(22) Filed: Jul. 26, 2005

(65) Prior Publication Data

US 2006/0151010 A1 Jul. 13, 2006

(30) Foreign Application Priority Data

Jan. 12, 2005 (KR) ..... 10-2005-0002810

(51) Int. Cl.
*B08B 3/02* (2006.01)

(52) U.S. Cl. ..... 134/110

(58) Field of Classification Search ..... 134/110
See application file for complete search history.

(56) References Cited

U.S. PATENT DOCUMENTS 3,807,420 A * 4/1974 Donselman et al. ..... 134/114
5,333,631 A * 8/1994 Kirkland et al. ..... 134/104.1
5,779,812 A * 7/1998 Thies et al. ..... 134/10
6,182,674 B1 * 2/2001 Jozwiak et al. ..... 134/56 R
2005/0022849 A1 2/2005 Park et al.
2005/0120533 A1 6/2005 Yoon et al.

FOREIGN PATENT DOCUMENTS

KR 2001-0077128 8/2001

OTHER PUBLICATIONS

English Language Abstract of KR 2001-0077128.
U.S. Appl. No. 11/095,561 to Kim et al., which was filed on Apr. 1, 2005.
U.S. Appl. No. 11/188,762 to Jeon et al., which was filed on Jul. 26, 2005.
U.S. Appl. No. 10/988,510 to Yoon et al., which was filed on Nov. 16, 2004.

* cited by examiner

*Primary Examiner*—Frankie L Stinson
*Assistant Examiner*—Samuel A Waldbaum
(74) *Attorney, Agent, or Firm*—McKenna Long & Aldridge LLP

(57) ABSTRACT

A drive unit for dish washing machines includes solid waste chambers with bottom surfaces that are stepped. One of the solid waste chambers has an inlet/outlet port. The solid waste chambers are inclined downward toward the inlet/outlet port. Consequently, filtering capacity is increased, and discharge of solid waste is facilitated.

15 Claims, 10 Drawing Sheets

DRIVE UNIT FOR DISH WASHING MACHINES

The present disclosure relates to subject matter contained in priority Korean Application No. 2005-0002810, filed on Jan. 12, 2005, the disclosure of which is herein expressly incorporated by reference in its entirety.

BACKGROUND OF THE INVENTION

1. Field of the Invention

The present invention relates to a dish washing machine, and more particularly, to a drive unit for dish washing machines that is capable of improving wash water filtering performance and wash water filtering capacity, effectively preventing a filter of the dish washing machine from being blocked by solid waste, and facilitating discharge of the solid waste.

2. Discussion of the Related Art

Generally, a dish washing machine is a machine that injects wash water to dishes to wash the dishes. A conventional dish washing machine is illustrated in FIG. 1. The construction of the conventional dish washing machine will be described hereinafter with reference to FIG. 1.

As illustrated in FIG. 1, the conventional dish washing machine comprises: upper and lower injection arms 4 and 5; upper and lower racks 6 and 7; and a drive unit 10, all of which are mounted in a tub 1. To the drive unit 10 are connected upper and lower connection pipes 2 and 3 for pumping wash water and a drain hose 9 for draining the wash water. The upper and lower connection pipes 2 and 3 are connected to the upper and lower injection arms 4 and 5, respectively. The upper rack 6 is disposed above the upper injection arm 4, and the lower rack 7 is disposed above the lower injection arm 5.

The upper and lower injection arms 4 and 5 are rotatably disposed above the drive unit 10. Each of the upper and lower injection arms 4 and 5 has injection holes for allowing wash water to be injected to the corresponding rack therethrough. In addition, the lower injection arm 5 has injection holes for allowing wash water to be injected therethrough to remove food particles from a filter of the drive unit.

The drive unit 10 will now be described in detail with reference to FIG. 2. The drive unit 10 comprises: a sump 20 for receiving wash water; a heater 30 mounted to the sump 20 for heating wash water; a washing pump mounted to the sump 20 for pumping out wash water; a drain pump mounted to the sump 20 for draining wash water; and filtering device for guiding some of the pumped-out wash water to the upper and lower injection arms 4 and 5 and filtering the remainder of the pumped-out wash water.

The sump 20 has a wash water receiving space 21 for substantially receiving wash water defined therein. Also, the sump 20 has a drain chamber 22, which is partitioned from the wash water receiving space 21. To the outside of the wash water receiving space 21 is mounted a flow channel control device 25. To the flow channel control device 25 is connected a flow channel control valve 26 via a shaft.

The washing pump comprises: a washing motor 41 disposed below the sump 20 for generating a driving force; and an impeller 42 mounted in the filtering device for pumping out wash water. The impeller 42 is connected to a shaft of the washing motor 41. The drain pump is mounted to the drain chamber 22 of the sump 20. The drain pump comprises a drain motor 51 and an impeller 52.

The filtering device comprises: a pump housing 60 having a space for allowing the impeller 42 to be mounted therein; a filter housing 70 mounted for covering the top of the pump housing 60; and a cover 80 mounted for covering the top of the filter housing 70 and the top of the sump 20. The pump housing 60 is disposed at the lower surface of the filter housing 70. The cover 80 is disposed at the upper surface of the filter housing 70.

The filter housing 70 has a solid waste chamber 75 defined therein. The solid waste chamber 75 has an outlet port 75*a*, which communicates with the drain chamber 22. The outlet port 75*a* extends a predetermined distance downward from the solid waste chamber 75 such that the outlet port 75*a* can be inserted into the drain chamber 22. The filter housing will be described below in more detail.

The cover 80 has a filter 81, which corresponds to the solid waste chamber 75 of the filter housing 70. At the cover, around the filter 81, are formed a plurality of collection holes 82. The collection holes 82 communicate with the sump 20.

The filter housing 70 will now be described in detail with reference to FIG. 3. As shown in FIG. 3, the filter housing 70 comprises: a wash water inlet port 72 for allowing wash water pumped out from the impeller 42 to be introduced therethrough; main flow channels 73*a* and 73*b* and a sampling flow channel 74 connected to the wash water inlet port 72; and a solid waste chamber 75 connected to the sampling flow channel 74. At the outlet port 75*a* of the solid waste chamber 75 is mounted an opening/closing valve for allowing wash water and food particles to be discharged from the solid waste chamber 75 to the drain chamber 22 when a draining operation is performed.

At the wash water inlet port 72 of the filter housing 70 is rotatably mounted a flow channel control valve 26 for opening or closing the main flow channels 73*a* and 73*b*. The flow channel control valve 26 is connected to the flow channel control device 25, which is mounted to the sump 20, via a shaft. At the edge of the channel control valve 26 is formed an opening/closing rib 26*a* for opening or closing the main flow channels 73*a* and 73*b*.

The operation of the dish washing machine with the above-stated construction will now be described. The dish washing machine successively or selectively performs a preliminary washing operation, a main washing operation, a rinsing operation, a heating and rinsing operation, and a drying operation to wash dishes. Draining operations are performed between the respective operations. Hereinafter, the main washing operation will be described in detail.

When the main washing operation is initiated, the washing motor 41 is rotated, and therefore, the impeller 42 is rotated. The impeller 42 pumps out wash water (containing a detergent) from the sump 20 to the wash water inlet port 72 of the pump housing 60. At this time, the flow channel control device 25 is rotated, and therefore, the flow channel control valve 26 either selectively opens the main flow channels 73*a* and 73*b*, as shown in FIG. 5A and FIG. 5B, or simultaneously opens the main flow channels 73*a* and 73*b*, as shown in FIG. 3. As a result, some of the wash water in the wash water inlet port 72 is introduced into the upper injection arm 4 and/or the lower injection arm 5 through the main flow channel 73*a* and/or the main flow channel 73*b*, and the remainder of the wash water is introduced into the solid waste chamber 75 through the sampling flow channel 74.

Preferably, the flow channel control valve 26 simultaneously or alternately opens the main flow channels 73*a* and 73*b* such that the wash water can be supplied to not only the upper injection arm 4 but also the lower injection arm 5. At this time, some of the wash water is always introduced into the sampling flow channel 74 irrespective of which main flow channel(s) is opened by the flow channel control valve 26.

The wash water introduced into the sampling flow channel 74 is directly guided into the solid waste chamber 75. The wash water guided into the solid waste chamber 75 overflows through the filter 81, which is disposed above the solid waste chamber 75. At this time, the filter 81 filters the wash water such that foreign matter is separated from the wash water.

The filtered wash water and the wash water dropping from the upper and lower injection arms 4 and 5 is introduced again into the sump 20 through the collection holes 82 of the cover 80. In this way, the wash water is filtered. It should be noted that some of the wash water is not filtered for a short period of time, but almost all of the wash water is filtered during the main washing operation.

After the washing operation is completed as described above, a draining operation is initiated. When the draining operation is initiated, the drain pump 51 and impeller 52 are operated. At this time, the wash water and the food particles are introduced into the drain pump 51 and impeller 52 from the sump 20 by a suction force of the drain pump 51 and impeller 52. At the same time, the wash water and the food particles are introduced into the drain pump 51 and impeller 52 from the solid waste chamber 75 through the outlet port 75*a*, as shown in FIG. 5B. The wash water and the food particles introduced into the drain pump 51 and impeller 52 are drained out of the dish washing machine through the drain hose 9.

However, the conventional dish washing machine has the following problems. First, the wash water pumped out from the sump is directly introduced into the solid waste chamber through the sampling flow channel. As a result, relatively large-sized solid waste is introduced into the solid waste chamber, and therefore, the filter of the cover is frequently blocked.

Secondly, the solid waste chamber is eccentrically disposed at a predetermined position of the filter housing such that the solid waste chamber deviates from the flow channel control valve and from the main flow channels. As a result, the size of the solid waste chamber is relatively decreased, and therefore, the filtering capacity is reduced. When the filtering capacity is reduced, the filter is frequently blocked.

Thirdly, the water pressure applied to the solid waste chamber is increased when the filter is blocked. As a result, the wash water is drained from the solid waste chamber through the drain hose. Consequently, wash water is excessively wasted. Fourthly, it is necessary to supplement wash water as the amount of wash water wasted is increased. When the heating and washing operation is performed, the supplemented wash water must be heated by the heater. As a result, the power consumption is increased, and time necessary to perform the heating and washing operation is increased.

Fifthly, the filter of the cover is easily deformed due to accumulated fatigue acting on the filter as the filter is frequently blocked. Sixthly, the bottom surface of the solid waste chamber is horizontally disposed, and therefore, solid waste, such as food particles, remains in the solid waste chamber. Consequently, the rinsing operation is not sanitarily performed.

SUMMARY OF THE INVENTION

Accordingly, the present invention is directed to a drive unit for dish washing machines that substantially obviates one or more problems due to limitations and disadvantages of the related art.

An object of the present invention is to provide a drive unit for dish washing machines that is capable of improving wash water filtering performance and wash water filtering capacity, effectively preventing a filter of the dish washing machine from being blocked by solid waste, and facilitating discharge of the solid waste.

To achieve these objects and other advantages and in accordance with the purpose of the invention, as embodied and broadly described herein, a drive unit for dish washing machines comprises: a sump for receiving wash water; and a housing assembly having: a first solid waste chamber for filtering some of the wash water pumped out from a washing impeller; a second solid waste chamber disposed to communicate with the first solid waste chamber, the second solid waste chamber having a bottom surface, which is not level with a bottom surface of the first solid waste chamber such that the bottom surfaces of the first and second solid waste chambers are stepped; and a filter disposed in correspondence to the first and second solid waste chambers.

Preferably, the second solid waste chamber is disposed such that the second solid waste chamber deviates from the first solid waste chamber. More preferably, the bottom surface of the first solid waste chamber is lower than that of the second solid waste chamber. Also preferably, the first solid waste chamber is provided at the bottom surface thereof with an inlet/outlet port for allowing wash water to be introduced into the first solid waste chamber therethrough when a washing operation is performed and allowing solid waste, which is separated from the wash water by filtering, to be discharged out of the first solid waste chamber therethrough when a draining operation is performed.

Preferably, the bottom surface of the first solid waste chamber and/or the bottom surface of the second solid waste chamber is inclined downward toward the inlet/outlet port. More preferably, the first and second solid waste chambers are partitioned from each other at the side opposite to the inlet/outlet port. Also preferably, communication holes are formed at the regions of the housing assembly surrounded by the first and second solid waste chambers, respectively, the communication holes communicating with the sump for discharging leaked wash water to the sump.

Preferably, the housing assembly comprises: a pump housing disposed in the sump, the pump housing having a washing impeller located therein; a flow channel housing disposed to cover the top of the pump housing, the flow channel housing having the first solid waste chamber; a filter housing disposed above the flow channel housing, the filter housing having the second solid waste chamber; and an arm holder disposed above the flow channel housing, the arm holder having the filter, which covers the tops of the first and second solid waste chambers. More preferably, the flow channel housing has flow channels for guiding some of the pumped-out wash water to washing arms. Also preferably, the filter housing has a filter opening, which corresponds to the first solid waste chamber.

In another aspect of the present invention, a drive unit for dish washing machines, comprises: a sump for receiving wash water; a pump housing disposed in the sump, the pump housing including a washing impeller located therein; a flow channel housing disposed to cover the top of the pump housing, the flow channel housing including a first solid waste chamber for filtering some of the wash water pumped out from the washing impeller; a filter housing including a second solid waste chamber disposed to communicate with the first solid waste chamber, the second solid waste chamber having a bottom surface, which is not level with a bottom surface of the first solid waste chamber such that the bottom surfaces of the first and second solid waste chambers are stepped; and an arm holder disposed above the filter housing, the arm holder having a filter positioned in correspondence to the first and second solid waste chambers.

Preferably, the first solid waste chamber is provided at the bottom surface thereof with an inlet/outlet port for allowing wash water to be introduced into the first solid waste chamber therethrough when a washing operation is performed and allowing solid waste, which is separated from the wash water by filtering, to be discharged out of the first solid waste chamber therethrough when a draining operation is performed. Also preferably, the first and/or second solid waste chambers is inclined downward toward the inlet/outlet port.

In a further aspect of the present invention, a drive unit for dish washing machines, comprises: a sump for receiving wash water; and a housing assembly having: a solid waste chamber for filtering some of the wash water pumped out from a washing impeller, the solid waste chamber having at least three steps; and a filter disposed corresponding to the solid waste chamber.

Preferably, the solid waste chamber is provided at the lowest step thereof with an inlet/outlet port for allowing wash water to be introduced into the solid waste chamber therethrough when a washing operation is performed and allowing solid waste, which is separated from the wash water by filtering, to be discharged out of the solid waste chamber therethrough when a draining operation is performed. Also preferably, all the steps of the solid waste chamber are inclined downward toward the inlet/outlet port.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and advantages of the present invention will be made apparent from the following description of the preferred embodiments, given as non-limiting examples, with reference to the accompanying drawings.

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
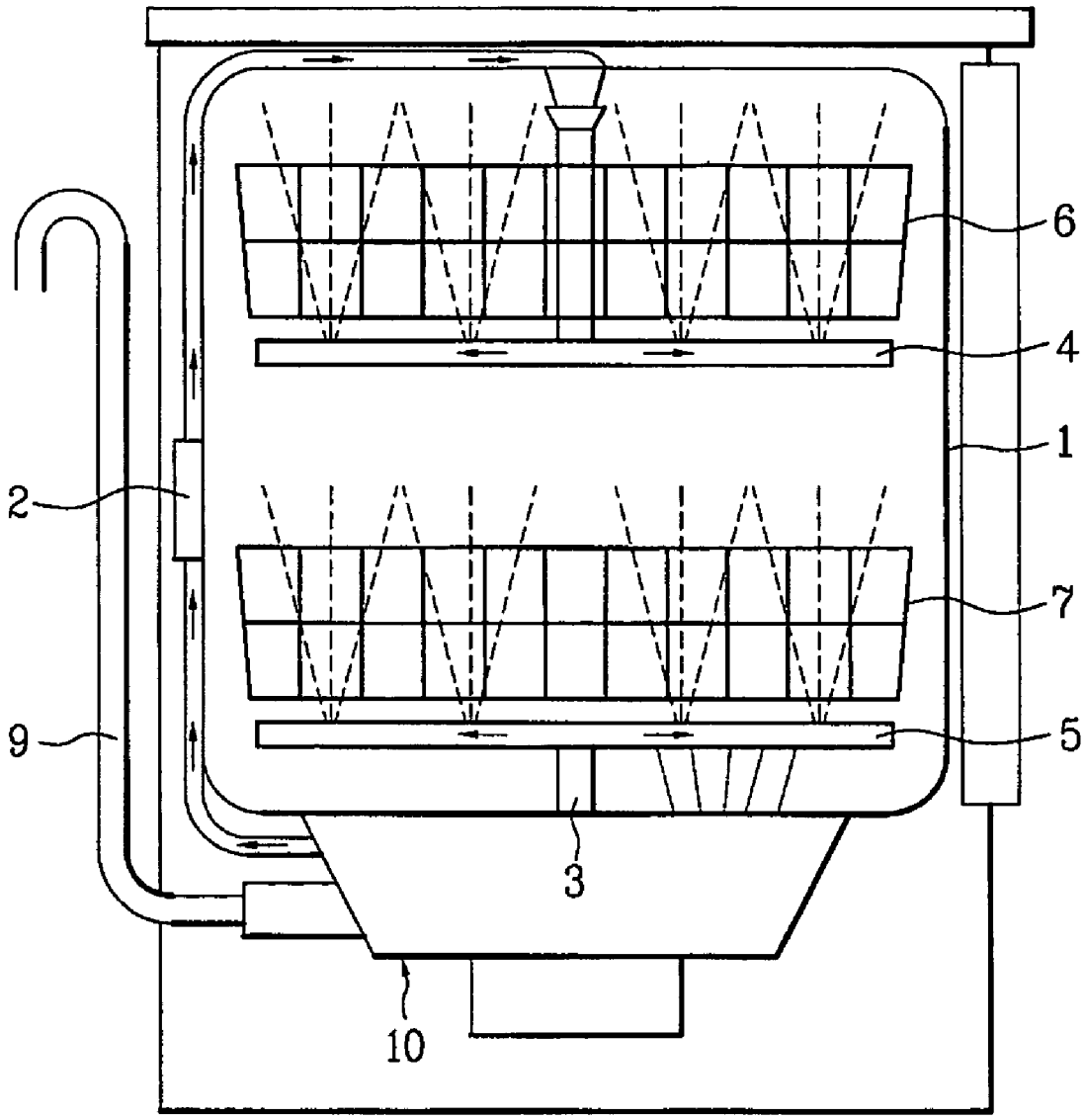
FIG. 1 Related Art
FIG. 1 is a side view illustrating the construction of a conventional dish washing machine.
Figure 2:
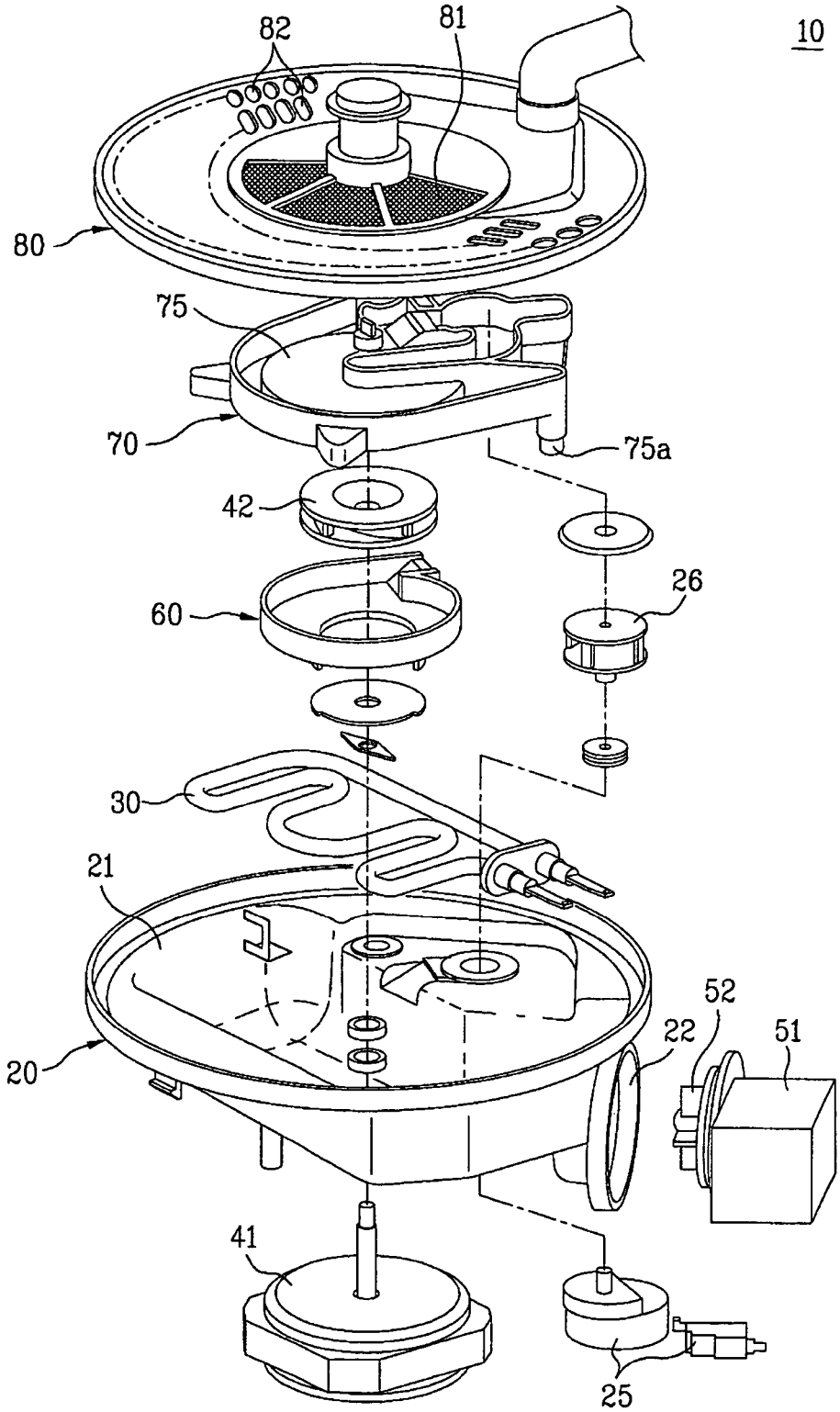
FIG. 2 Related Art
FIG. 2 is an exploded perspective view illustrating the drive unit for dish washing machines of FIG. 1.
Figure 3:
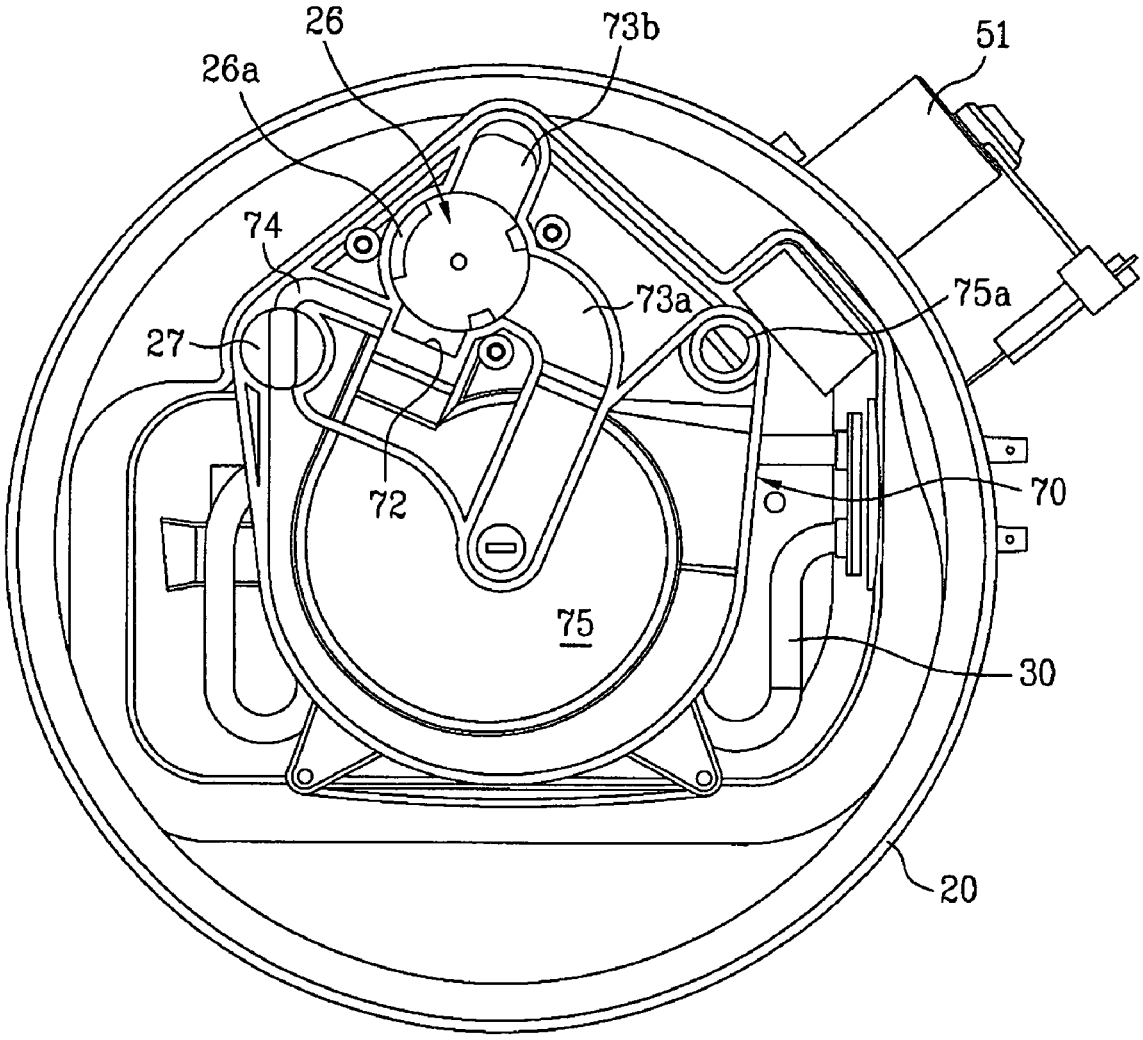
FIG. 3 Related Art
FIG. 3 is a plan view illustrating the structure of the flow channel of the filter housing of FIG. 2.
Figure 4:
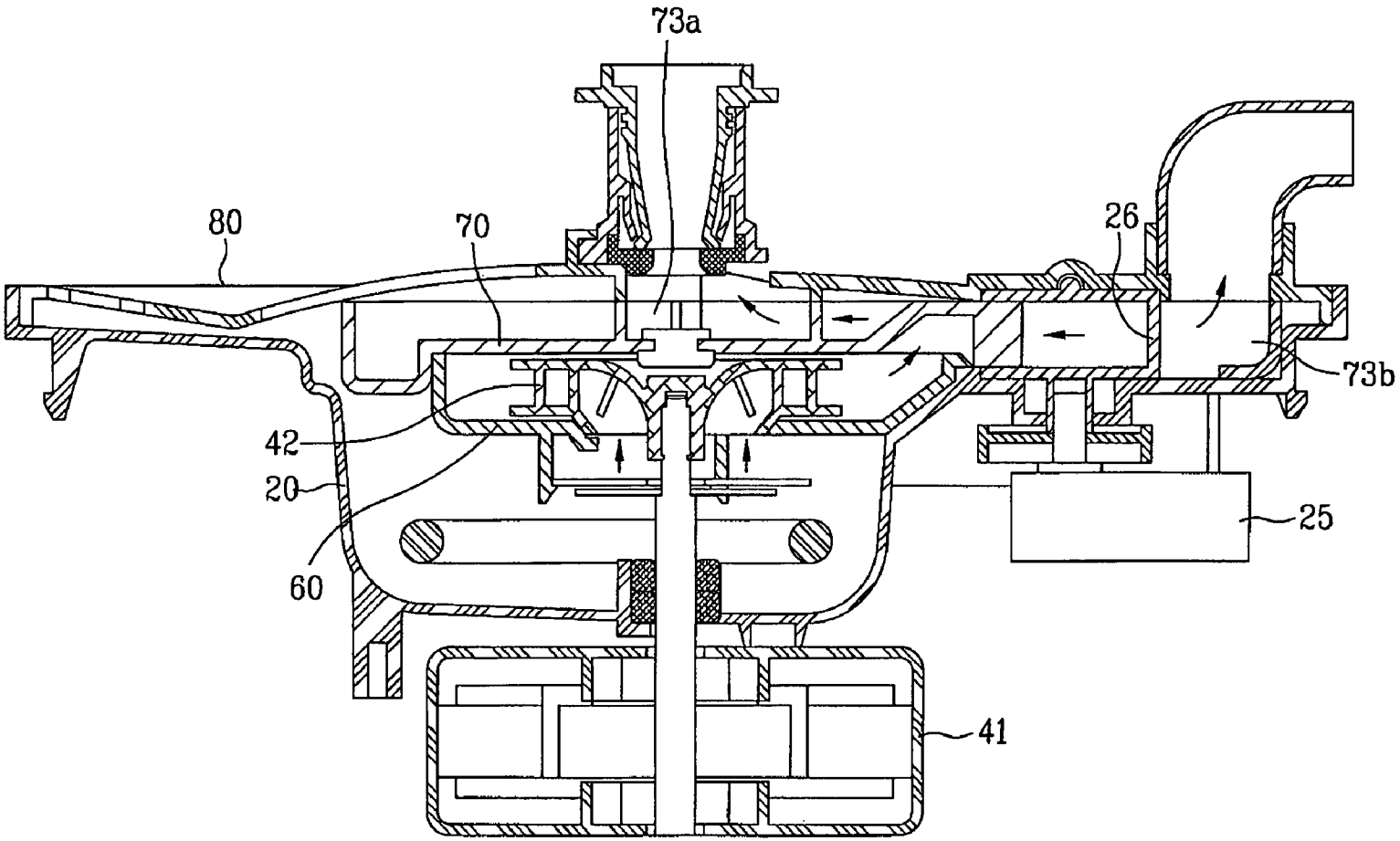
FIG. 4 Related Art
FIG. 4 is a sectional view illustrating flow of wash water in the drive unit of FIG. 2 when a washing operation is performed.
Figure 5A:
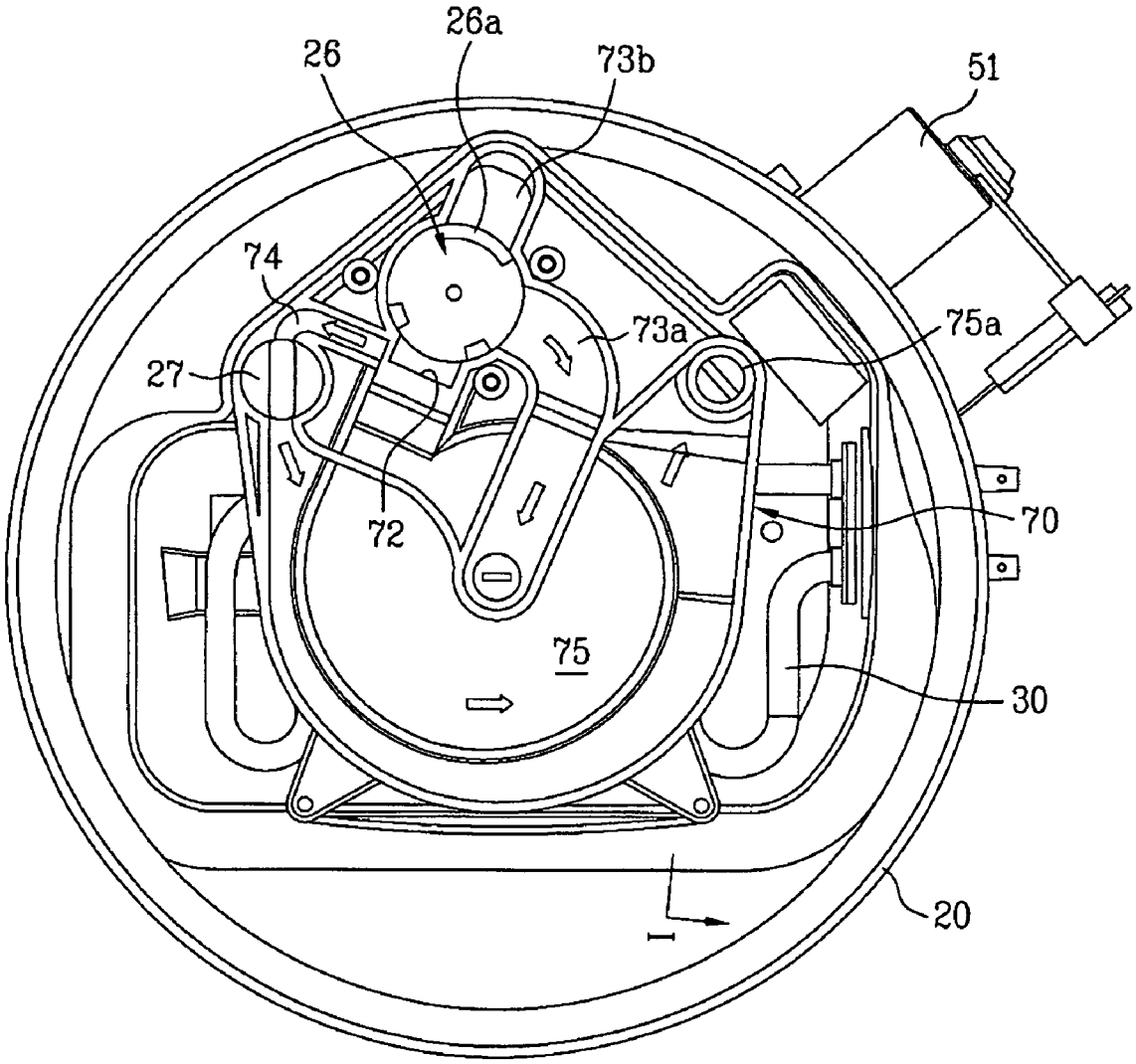
FIG. 5A Related Art
FIG. 5A is a plan view illustrating flow of wash water in the filter housing of FIG. 2 when a washing operation is performed.
Figure 5B:
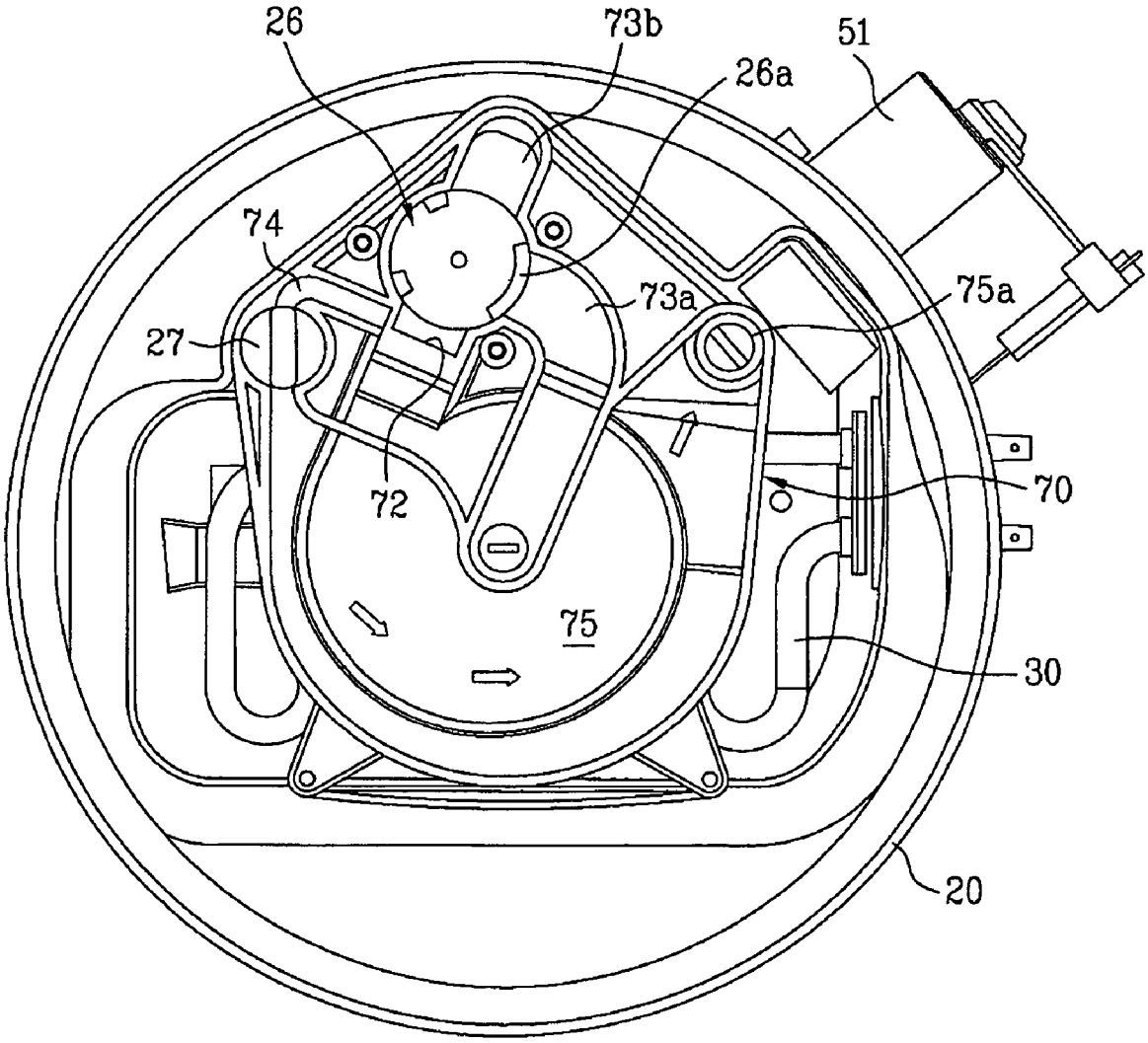
FIG. 5B Related Art
FIG. 5B is a plan view illustrating flow of wash water in the filter housing of FIG. 2 when a draining operation is performed.

The present invention is further described in the detailed description which follows, by reference to the noted plurality of drawings by way of non-limiting examples of preferred embodiments of the present invention, in which like reference numerals represent similar parts throughout the several views of the drawings.

Figure 6:
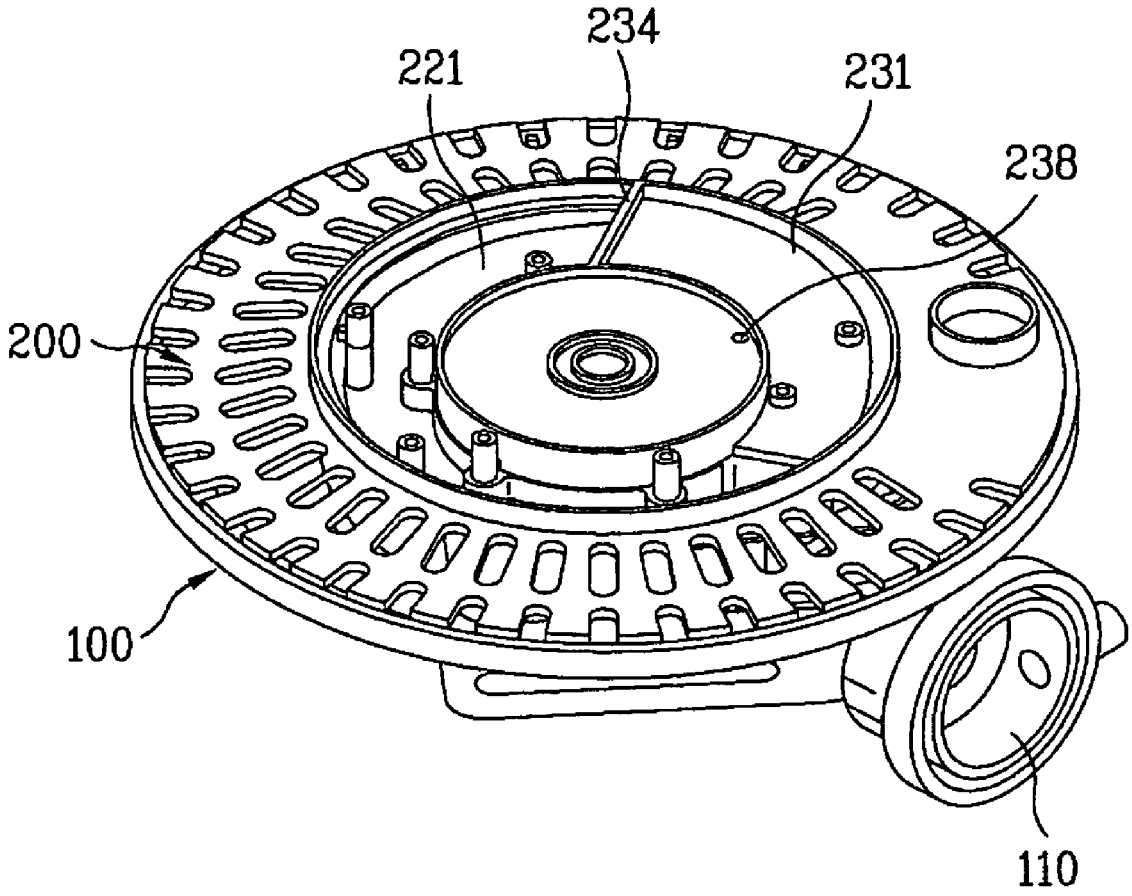
FIG. 6 is a perspective view illustrating a drive unit for dish washing machines according to the present invention.

FIG. 6 is a perspective view illustrating a drive unit for dish washing machines according to the present invention. As shown in FIG. 6, the drive unit comprises: a sump 100 for receiving wash water; and a housing assembly 200 for pumping and filtering the wash water. The housing assembly 200 comprises: a first solid waste chamber 221 for filtering some of the wash water pumped out from a washing impeller 120; a second solid waste chamber 231 disposed to communicate with the first solid waste chamber 221, the second solid waste chamber 231 having a bottom surface, which is not level with a bottom surface of the first solid waste chamber 221 such that the bottom surfaces of the first and second solid waste chambers 221 and 231 are arranged in the shape of a step; and a filter 241 (See FIG. 7) disposed corresponding to the first and second solid waste chambers 221 and 231.

The second solid waste chamber 231 is disposed such that the second solid waste chamber 231 deviates from the first solid waste chamber 221. For example, the first solid waste chamber 221 and the second solid waste chamber 231 are connected to each other and have the shape of a ring. In this case, the first and second solid waste chambers 221 and 231 take the shape of a circular arc. Preferably, the second solid waste chamber 231 is constructed to cover the top of a predetermined region of the housing assembly 200 where a flow channel control valve 130 and main flow channels 222 are disposed. As a result, the region of the housing assembly 200 where the solid waste chamber cannot be formed due to the flow channel control valve and the main flow channels in the conventional art is available to be used as the solid waste chamber, and therefore, the size of the solid waste chambers 221 and 231 is considerably increased. However, the shape of the first and second solid waste chambers 221 and 231 is not limited to the above-mentioned ring. For example, the first and second solid waste chambers 221 and 231 may be formed in the shape of, for example, a square or rectangular frame, a triangular frame, or an elliptical doughnut.

Preferably, the bottom surface of the first solid waste chamber 221 is lower than that of the second solid waste chamber 231. In this case, the region of the housing assembly 200 where the flow channel control valve 130 and the main flow channels 222 are not disposed is effectively utilized to increase the size of the first solid waste chamber 221. Preferably, at the bottom surface of the first solid waste chamber 221 an inlet/outlet port 225 is formed (See FIG. 7) for allowing wash water to be introduced into the first solid waste chamber 221 therethrough when a washing operation is performed and allowing solid waste, which is separated from the wash water by filtering, to be discharged out of the first solid waste chamber 221 therethrough when a draining operation is performed.

Alternatively, the bottom surface of the second solid waste chamber 231 may be lower than that of the first solid waste chamber 221. In this case, it is natural that the inlet/outlet port 225 is formed at the second solid waste chamber 231. Also preferably, the bottom surface of the first solid waste chamber 221 and/or the bottom surface of the second solid waste chamber 231 is inclined downward toward the inlet/outlet port 225. In this case, the wash water is smoothly discharged from the first and second solid waste chambers 221 and 231 to a drain pump when the draining operation is performed.

Preferably, the first and second solid waste chambers 221 and 231 communicate with each other in the vicinity of the inlet/outlet port 225. In this case, the first and second solid waste chambers 221 and 231 are inclined downward to the inlet/outlet port 225. Consequently, the difference in height between the bottom surface of the first solid waste chamber 221 and the bottom surface of the second solid waste chamber 231 is maximized in the vicinity of the inlet/outlet port 225.

More preferably, the first and second solid waste chambers 221 and 231 are partitioned from each other at the side opposite to the inlet/outlet port 225. For example, both ends of the first solid waste chamber 221 are connected to both ends of the second solid waste chamber 231 when the first and second solid waste chambers 221 and 231 are connected to each other such that the first and second solid waste chambers 221 and 231 are arranged in the shape of a ring. At one of the two connections where the first and second solid waste chambers 221 and 231 are connected to each other, which is opposite to the wash water inlet side, a partition rib 234 is formed. Consequently, the wash water introduced into the first solid waste chamber 221 is prevented from flowing along the first and second solid waste chambers 221 and 231 in the circumferential direction.

Also preferably, communication holes 228 and 238 are formed at the regions of the housing assembly 200 surrounded by the first and second solid waste chambers 221 and 231, respectively. The communication holes 228 and 238 communicate with the sump 100 for discharging leaked wash water to the sump 100. Preferably, the communication holes 228 and 238 are disposed such that the communication holes 228 and 238 deviate from an impeller location part 211 where the washing impeller 120 is located.

Figure 7:
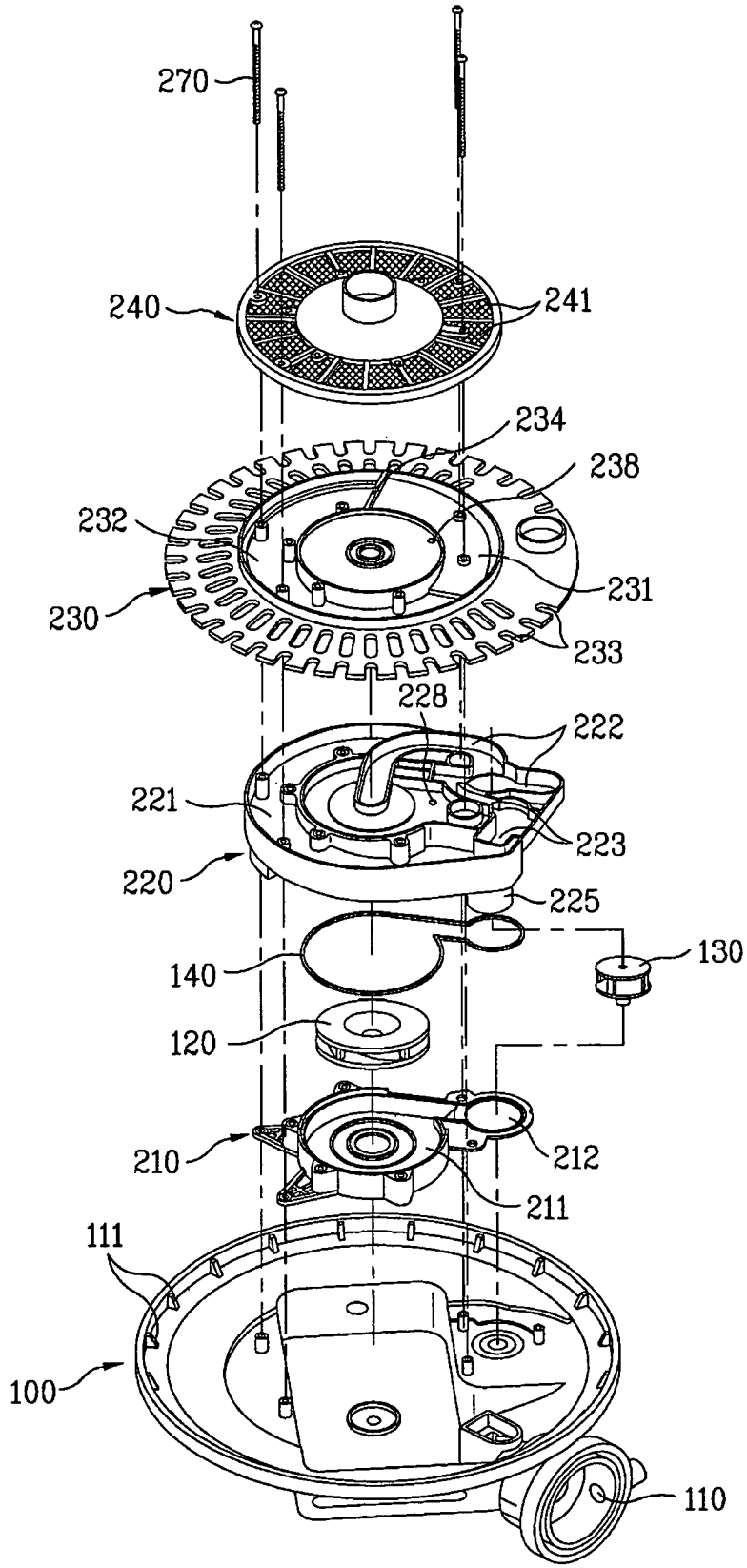
FIG. 7 is an exploded perspective view illustrating the drive unit for dish washing machines of FIG. 6.

The drive unit for dish washing machines will now be described in more detail with reference to FIG. 7. As shown in FIG. 7, the housing assembly 200 comprises a pump housing 210 disposed in the sump 100. The washing impeller 120 is located in the pump housing 210. The housing assembly 200 further comprises: a flow channel housing 220 disposed to cover the top of the pump housing 210, the flow channel housing 220 having the first solid waste chamber 221; a filter housing 230 disposed above the flow channel housing 220, the filter housing 230 having the second solid waste chamber 231; and an arm holder 240 disposed above the flow channel housing 220, the arm holder 240 having the filter 241, which covers the tops of the first and second solid waste chambers 221 and 231.

Between the pump housing 210 and the flow channel housing 220 is disposed a sealing member 140 for preventing leakage of wash water. Also, another sealing member, which is not shown, is disposed between the flow channel housing 220 and the filter housing 230. Still another sealing member, which is also not shown, is disposed between the filter housing 230 and the arm holder 240. Each of these sealing members can be of any appropriate type and of any appropriate material, and will have a shape corresponding to a shape of the junction between the respective elements being sealed thereby.

The impeller location part 211 is formed at the pump housing 210 such that the washing impeller 120 is located in the impeller location part 211. At the pump housing 210 an insertion part 212 is also formed, through which the flow channel control valve 130 is inserted. The pump housing 210 with the above-stated construction is located in the sump 100. In this case, it is possible to connect the impeller 120 to the shaft of a washing motor (not shown) after the pump housing 210 is located in the sump 100. Consequently, easier installation of the impeller 120 is accomplished.

The main flow channels 222, which guide some of the pumped-out wash water to washing arms, are formed at the flow channel housing 220. At the flow channel housing 220 a sampling flow channel 223 is provided for guiding some of the pumped-out wash water to the first and second solid waste chambers 221 and 231 through a drain chamber 110. More specifically, the inlet/outlet port 225 is formed at the flow channel housing 220. The inlet/outlet port 225 is connected to the drain chamber 110. The sampling flow channel 223 is formed by vertically partitioning the inlet/outlet port 225. Consequently, relatively large-sized solid waste is deposited when the wash water in the sampling flow channel 223 passes through the drain chamber 110. In this way, a primary filtering operation is performed. The filtered wash water is introduced into the first and second solid waste chambers 221 and 231 where the wash water is secondarily filtered. At the drain chamber 110 a drain pump (not shown) is mounted.

At the filter housing 230 a filter opening 232 is formed, which corresponds to the first solid waste chamber 221. The filter opening 232 of the filter housing 230 and the top of the second solid waste chamber 231 are covered by the filter 241 of the arm holder 240. The filter 241 of the arm holder 240 is arranged in the shape of a ring.

The communication holes 228 and 238 are formed at the flow channel housing 220 and the filter housing 230, respectively, such that the communication holes 228 and 238 communicate with the sump 100. The communication holes 228 and 238 deviate (i.e., are spaced) from the impeller location part 211 of the pump housing 210. Consequently, wash water that leaks in the regions of the flow channel housing 220 and the filter housing 230 surrounded by the solid waste chambers 221 and 231 is collected into the sump 100 through the communication holes 228 and 238, respectively.

At the edge of the filter hosing 230 collection holes 233 are formed. Each of the collection holes 233 has an opened outside, and communicates with the sump 100. Each of the collection holes 233 may be formed in various shapes. At the upper end of the edge of the sump 100 are preferably formed fixing ribs 111, which are inserted into the collection holes 233 of the filter housing 230, respectively, for securely fixing the filter housing 230.

After the pump housing 210 is mounted in the sump 100, the washing impeller 120 is mounted in the pump housing 210. At this time, the impeller 120 is securely fitted on the shaft of the washing motor (not shown). Subsequently, the flow channel housing 220, the filter housing 230 and the arm holder 240 are mounted one by one. After that, the sump 100, the pump housing 210, the flow channel housing 220, the filter housing 230 and the arm holder 240 are securely fixed to one another by means of fixing members 270.

Although not shown, a solid waste chamber having at least three successive steps may be provided and is within the scope of the present invention. In this case, the inlet/outlet port 225 is preferably disposed at the lowest step of the solid waste chamber. Also preferably, all the steps of the solid waste chamber are inclined downward toward the inlet/outlet port 225. In this structure, the wash water is filled in the respective steps one by one, and solid waste is easily drained when the draining operation is performed.

As described above, the housing assembly 200 is configured by mechanically assembling the flow channel housing 220, the filter housing 230 and the arm holder 240. Alternatively, the flow channel housing 220, the filter housing 230 and the arm holder 240 may be integrally fixed to one another by thermal fusion to configure the housing assembly 200. Also, it is easily understood that the above-mentioned various flow channels may take various forms.

The operation of the drive unit for dish washing machines with the above-stated construction according to the present invention will now be described in detail. Specifically, a main washing operation will be described with reference to FIGS. 8 to 10. When the main washing operation is initiated, the impeller 120 introduces wash water from the sump 100 to the impeller location part 211. The wash water is pumped out, and is then introduced to the wash water inlet port of the flow channel housing 220.

Figure 8:
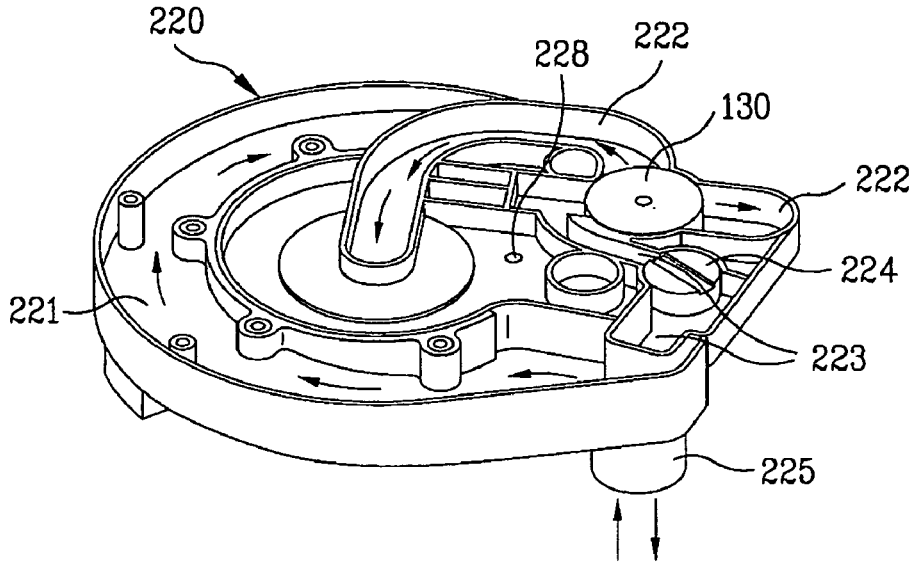
FIG. 8 is a perspective view illustrating a flow of wash water in the flow channel housing of FIG. 6 when a washing operation is performed.

As the flow channel control valve 130 is rotated, as shown in FIG. 8, the main flow channels 222 are selectively, simultaneously, or alternately opened or closed. At this time, some of the pumped-out wash water is introduced into the upper injection arm and/or the lower injection arm through the main flow channels 222. Also, some of the pumped-out wash water is introduced into the sampling flow channel 223. At this time, the wash water is introduced into the sampling flow channel 223 irrespective of which main flow channel(s) 222 is opened by the flow channel control valve 130.

The wash water introduced into the sampling flow channel 223 flows into the drain chamber 110 through the inlet/outlet port 225. A pollution level detecting device 224 is mounted in the sampling flow channel 223. The pollution level detecting device 224 serves to detect the pollution level of the wash water and transmit the detected pollution level of the wash water to a control unit. Introduction of the wash water into the drain chamber is not illustrated in FIG. 8.

Relatively large-sized food particles, which are contained in the wash water in the drain chamber 110, are deposited on the bottom surface of the drain chamber 110. Consequently, the food particles are primarily separated from the wash water in the drain chamber 110. The drain chamber 110 serves as a submerged tank when the washing operation is performed.

Figure 9:
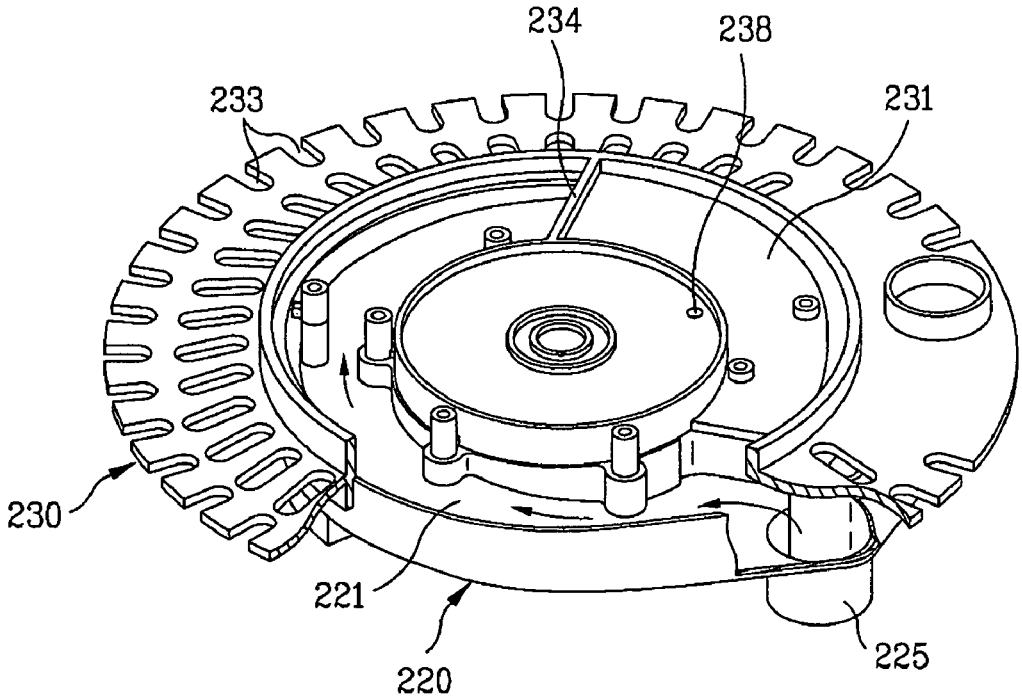
FIGS. 9 and 10 are perspective views illustrating flow of wash water in the housing assembly, excluding the arm holder, of FIG. 6 when a washing operation is performed.

Referring to FIG. 9, the wash water introduced into the drain chamber 110 flows into the first solid waste chamber 221 through the inlet/outlet port 225. At this time, food particles are accumulated in the first solid waste chamber 221 from the partition rib side to the wash water inlet side. Also, relatively large-sized food particles are deposited in the drain chamber 110. As a result, relatively small-sized food particles are introduced into the first solid waste chamber 221, and therefore, the amount of food particles introduced into the first solid waste chamber 221 is decreased.

Figure 10:
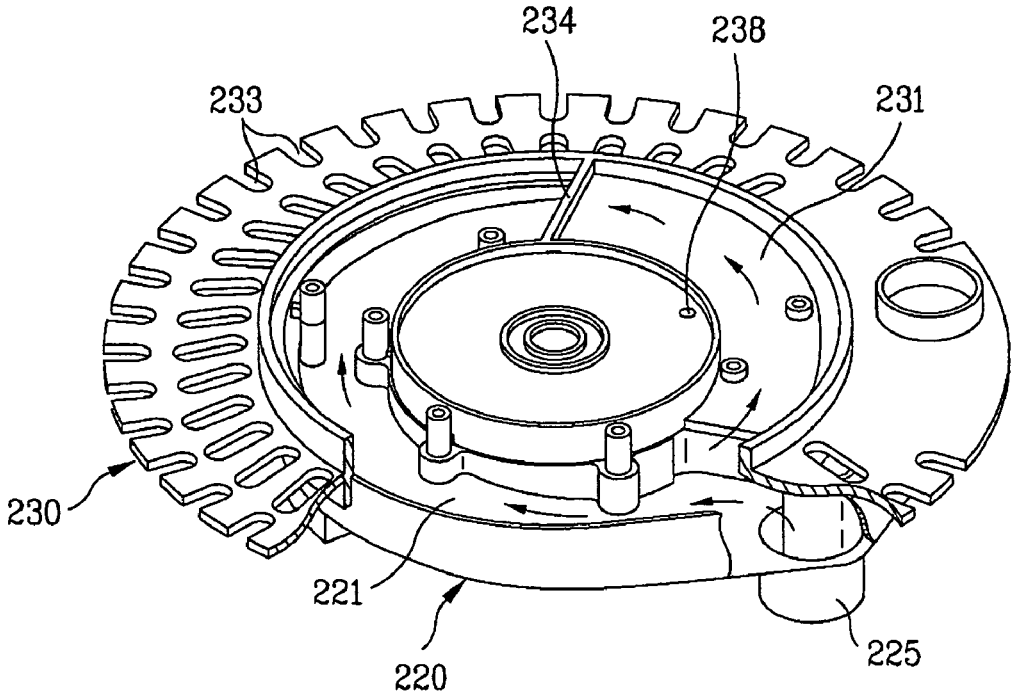

As the amount of wash water introduced into the first solid waste chamber 221 is gradually increased, the wash water is introduced into the second solid waste chamber 231, as shown in FIG. 10. At this time, the partition rib 234 prevents the wash water from flowing from the first solid waste chamber 221 to the second solid waste chamber 231. Also, food particles are accumulated in the second solid waste chamber 231 from the partition rib side to the wash water inlet side. As a result, the filter 241 is effectively prevented from being blocked.

As described above, the wash water is introduced into the first and second solid waste chambers 221 and 231 via the drain chamber 110. Consequently, the water pressure applied to the first and second solid waste chambers 221 and 231 is relatively decreased as compared to the prior art, and therefore, the amount of food particles introduced into the first and second solid waste chambers 221 and 231 is decreased. Also, the filtering capacity is increased, and therefore, the filter 241 of the arm holder 240 is effectively prevented from being blocked. Moreover, the food particles are accumulated in the first and second solid waste chambers 221 and 231 from the partition rib side to the wash water inlet side, and therefore, the filter 241 is effectively prevented from being blocked.

The wash water introduced into the first and second solid waste chambers 221 and 231 as described above overflows through the filter 241. At this time, relatively small-sized food particles contained in the wash water are secondarily separated from the wash water by the filter 241. The filtered wash water is introduced again into the sump 100 through the collection holes 233 of the filter housing 230. Here, the pumping force of the impeller 120 creates water pressure, by which the wash water is introduced into the first and second solid waste chambers 221 and 231 via the drain chamber 110.

A small amount of wash water leaks through gaps between the flow channel housing 220, the filter housing 230 and the arm holder 240, and is then introduced into the regions of the housing assembly 200 surrounded by the first and second solid waste chambers 221 and 231. The leaked wash water is collected into the sump 100 through the communication holes 228 and 238. Consequently, the drive unit is sanitarily used.

Figure 11:
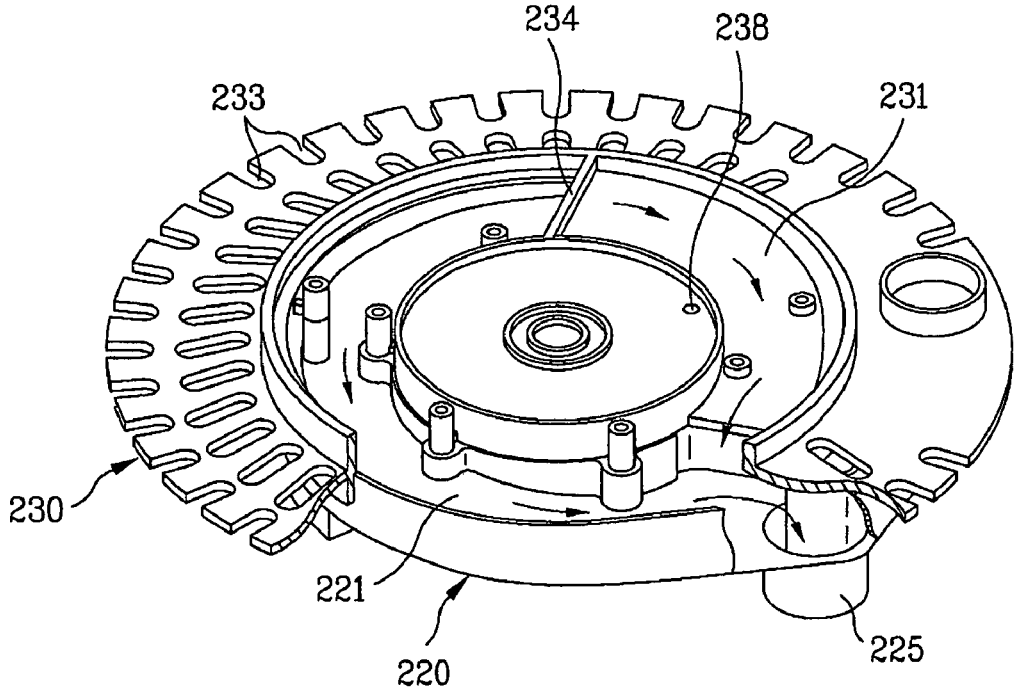
FIG. 11 is a perspective view illustrating flow of wash water in the housing assembly, excluding the arm holder, of FIG. 6 when a draining operation is performed.

After the washing operation is completed, a draining operation is initiated. When the draining operation is initiated, the drain pump is operated. At this time, the wash water and the food particles are introduced into the drain chamber 110 from the sump 100. At the same time, the wash water and the food particles are introduced into the drain chamber 110 from the first and second solid waste chambers 221 and 231 through the inlet/outlet port 225, as shown in FIG. 11. The bottom surfaces of the first and second solid waste chambers 221 and 231 are inclined downward toward the inlet/outlet port 225. Consequently, discharge of the food particles from the first and second solid waste chambers 221 and 231 is facilitated. Also, circulation of the food particles in the first and second solid waste chambers 221 and 231 is prevented by the partition rib 234. Consequently, the food particles are completely discharged when the wash water is drained. The wash water and the food particles introduced into the drain chamber 110 are drained out of the dish washing machine through the drain port.

As apparent from the above description, the drive unit for dish washing machines according to the present invention has the following effects. First, some of the pumped-out wash water is deposited in the drain chamber, and is then introduced into the first and second solid waste chambers. As a result, a small amount of solid waste, such as relatively small-sized food particles, is introduced into the first and second solid waste chambers. Consequently, the filter is effectively prevented from being blocked, and an increase of the water pressure in the first and second solid waste chambers is prevented.

Secondly, the second solid waste chamber is disposed above the flow channel control valve and the various flow channels. Consequently, the solid waste chambers can be constructed irrespective of the positions where the flow channel control valve and the main flow channels are disposed. Furthermore, the size of the solid waste chambers is relatively increased, and the filtering capacity is also increased.

Thirdly, relatively small water pressure is applied to the first and second solid waste chambers. As a result, the wash water is not excessively drained, and therefore, supplementing of the wash water is not necessary. Consequently, the amount of consumed wash water and the power consumption are prevented from being excessively increased. Furthermore, deformation of the filter is effectively prevented.

Fourthly, the bottom surfaces of the first and second solid waste chambers are inclined downward toward the wash water draining side. As a result, solid waste, such as food particles, are effectively prevented from remaining in the first and second solid waste chambers when the draining operation is performed. Consequently, the rinsing operation is sanitarily performed.

Fifthly, the communication holes are formed at the regions of the housing assembly surrounded by the first and second solid waste chambers, respectively. As a result, the wash water leaking from between the flow channel housing and the filter housing is drained through the communication holes. Consequently, the drive unit for dish washing machines according to the present invention is more sanitarily used.

Although the invention has been described with reference to an exemplary embodiment, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

What is claimed is:

1. A dish washing machine, comprising:

a sump for receiving wash water; and a housing assembly having:

a first solid waste chamber into which a portion of the wash water is introduced;

a second solid waste chamber arranged side by side with the first solid waste chamber and having a bottom surface higher than a bottom surface of the first solid waste chamber; and a filter disposed to cover both tops of the first and second solid waste chambers, wherein the first and second solid waste chambers communicate with each other in the vicinity of the inlet/outlet port which is for allowing wash water to be introduced into the first solid waste chamber therethrough when a washing operation is performed and for allowing solid waste to be discharged out of the first solid waste chamber therethrough when a draining operation is performed.

2. The dish washing machine as set forth in claim 1, wherein the second solid waste chamber is disposed such that the second solid waste chamber deviates from the first solid waste chamber.

3. The dish washing machine as set forth in claim 2, wherein the first and second solid waste chambers are connected to each other in the shape of a ring.

4. The dish washing machine as set forth in claim 3, further comprising:

communication holes formed at the regions of the housing assembly surrounded by the first and second solid waste chambers, respectively, the communication holes communicating with the sump for discharging leaked wash water to the sump.

5. The dish washing machine as set forth in claim 2, wherein the bottom surface of the first solid waste chamber is lower than that of the second solid waste chamber.

6. The dish washing machine as set forth in claim 1, wherein the bottom surface of the first solid waste chamber is inclined downward toward the inlet/outlet port.

7. The dish washing machine as set forth in claim 1, wherein the bottom surface of the second solid waste chamber is inclined downward toward the inlet/outlet port.

8. The dish washing machine as set forth in claim 1, wherein the first and second solid waste chambers are partitioned from each other at the side opposite to the inlet/outlet port.

9. A dish washing machine comprising:

a sump for receiving wash water;

a pump housing disposed in the sump, the pump housing having a washing impeller located therein;

a flow channel housing disposed to cover a top of the pump housing, the flow channel housing having a first bottom surface to form a first solid waste chamber into which a portion of the wash water pumped out from the washing impeller is introduced;

a filter housing coupled onto the flow channel housing, the filter housing having an opening arranged above the first solid waste chamber and a second bottom surface to form a second solid waste chamber; and an arm holder disposed above the flow channel housing, the arm holder having a filter, which covers both tops of the first and second solid waste chambers, wherein the first and second solid waste chambers communicate with each other in the vicinity of the inlet/outlet port which is for allowing wash water to be introduced into the first solid waste chamber therethrough when a washing operation is performed and for allowing solid waste to be discharged out of the first solid waste chamber therethrough when a draining operation is performed.

10. The dish washing machine as set forth in claim 9, wherein the flow channel housing has flow channels for guiding some of the pumped-out wash water to washing arms, and the filter housing has a filter opening, which corresponds to the first solid waste chamber.

11. The dish washing machine as set forth in claim 10, wherein the filter hosing is provided at the edge thereof with collection holes, which communicate with the sump, each of the collection holes having an opened outside.

12. The dish washing machine as set forth in claim 11, wherein the sump is provide at the upper end of the edge thereof with fixing ribs, which are inserted into the collection holes of the filter housing, respectively, for securely fixing the filter housing.

13. A dish washing machine comprising:

a sump for receiving wash water;

a pump housing disposed in the sump, the pump housing having a washing impeller located therein;

a flow channel housing disposed to cover the top of the pump housing, the flow channel housing having a first solid waste chamber for filtering some of the wash water pumped out from the washing impeller;

a filter housing having a second solid waste chamber disposed to communicate with the first solid waste chamber, the second solid waste chamber having a bottom surface, which is not level with a bottom surface of the first solid waste chamber such that the bottom surfaces of the first and second solid waste chambers are arranged in the shape of a step; and an arm holder disposed above the filter housing, the arm holder having a filter disposed corresponding to the first and second solid waste chambers, wherein the first and second solid waste chambers communicate with each other in the vicinity of the inlet/outlet port which is for allowing wash water to be introduced into the first solid waste chamber therethrough when a washing operation is performed and for allowing solid waste to be discharged out of the first solid waste chamber therethrough when a draining operation is performed.

14. The dish washing machine as set forth in claim 13, wherein the first and second solid waste chambers are inclined downward toward the inlet/outlet port.

15. A dish washing machine comprising:

a sump for receiving wash water; and a housing assembly having a multi-stepped bottom to form a plurality of solid waste chambers arranged side by side with each other and a filter arranged to cover tops of the plurality of solid waste chambers, wherein at least two chambers of the plurality of solid waste chambers communicate with each other in the vicinity of the inlet/outlet port which is for allowing wash water to be introduced into the first solid waste chamber therethrough when a washing operation is performed and for allowing solid waste to be discharged out of the first solid waste chamber therethrough when a draining operation is performed.

* * * * *